United States Patent [19]

Oi

[11] 3,967,093

[45] June 29, 1976

[54] HEATING APPARATUS WITH HEAT MEDIUM VAPOR

[76] Inventor: Shigeo Oi, 929-4 Nakahigano, Inasato-cho, Nagano, Japan

[22] Filed: June 10, 1974

[21] Appl. No.: 477,616

[30] Foreign Application Priority Data

June 14, 1973 Japan ..... 48-66411

[52] U.S. Cl. ..... 219/388; 219/274; 165/105; 122/366

[51] Int. Cl.[2] ..... H05B 1/02

[58] Field of Search ..... 165/105; 122/366; 219/273, 274, 401, 388

[56] References Cited

UNITED STATES PATENTS

| | | | |
|---|---|---|---|
| 502,418 | 8/1893 | Kreusler | 122/366 X |
| 502,728 | 8/1893 | Kreusler | 122/366 X |
| 502,729 | 8/1893 | Kreusler | 122/366 |
| 3,728,518 | 4/1973 | Kodaira | 165/105 X |
| 3,812,908 | 5/1974 | Coville et al. | 165/105 |

*Primary Examiner*—Albert W. Davis, Jr.
*Attorney, Agent, or Firm*—Cullen, Settle, Sloman & Cantor

[57] ABSTRACT

An electric heater is disposed horizontally along the free level of heat medium liquid within a vapor chamber, said electric heater being surrounded by a layer of porous material with void therebetween so that the heat medium liquid arises by capillary action and a thin film of the heat medium liquid formed in the void in the state of face contact to the electric heater is heated and vaporized. The lower portion of the porous material layer being immersed in the heat medium liquid and the other portion of it being exposed above the free level of the heat medium liquid thus the vapored heat medium fills the vapor chamber immediately.

1 Claim, 6 Drawing Figures

HEATING APPARATUS WITH HEAT MEDIUM VAPOR

This invention relates to improved heating apparatus for heat treatment of synthetic fiber of the like with heat medium vapor.

More particularly, the heating apparatus of the present invention is filled with substantially small volume of heat medium liquid in its bottom and a heat medium vapor chamber is formed above the free level of the heat medium liquid.

In the conventional heating apparatus of this kind, a laterally elongate heater is submerged in heat medium liquid and to produce vapor the liquid therearound is heated with this heater until the temperature of the whole liquid is raised by convection to vaporing temperature.

Therefore it takes a considerably long time before the liquid comes to vapor. Also since heating is gradually effected from beneath the level of the liquid, it often causes sudden abrupt boiling. This splashes liquid drips to impinge directly upon the heat exchange surface of the heating apparatus whereby the temperature of this portion is locally raised. Thus this produces ununiform temperature distribution of the heating apparatus.

One object of the present invention is to heat the film of heat medium liquid in contact with heater with heat conduction of high temperature and to immediately vaporize the heated liquid without allowing it to circulate by convection.

Other object is to deliver immediately heat medium vapor produced from liquid to the vapor chamber so as to avoid from sudden abrupt boiling.

Further object is to dispose a heater partially exposed with its top low above the liquid level, yet to increase the vaporing area.

Still another object is to minimize the capacity of liquid to be filled in the liquid container so as to be economical.

To achieve these objects, the apparatus of the present invention is so constructed that substantially small volume of heat medium liquid is filled in the bottom of a laterally elongate container and a heater is disposed along the free level of the liquid, said heater being covered with a layer of porous material and the lower part of the porous material is immersed in the liquid and its upper part is exposed above the liquid level.

Other objects and advantages of the present invention will become more apparent as description proceeds with reference to the accompanying drawings in which.

Figure 1:
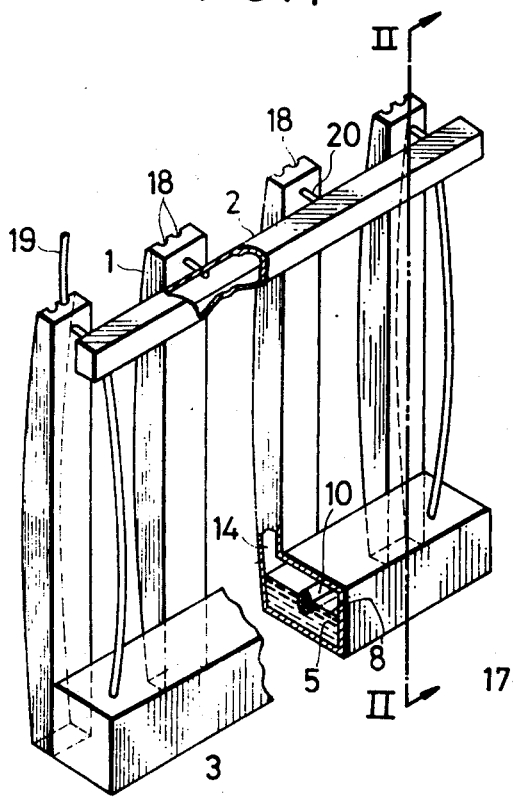
FIG. 1 is a perspective view of a heating apparatus with heat medium vapor of the present invention, a part of it being cut.

A plurality of closed elongate vessels 1 are arranged in spaced apart relation to one another, the upper parts of the vessels being communicated with a lateral condensate through 2 and the lower parts of the vessels being communicated to one another with a heat medium liquid container 3. In the container, an elongate electric heater 4 is disposed horizontally, the lower portion 6 of which is immersed in heat medium liquid 5 filled in the container and the upper portion 7 of the heater being exposed to a heat medium vapor chamber 9 above the free level 8 of the heat medium liquid. Said electric heater 4 is surrounded by a layer of heat resistant porous material 10.

Void 11 is formed between the outer periphery of the electric heater 4 and porous material 10 which is partially immersed in the heat medium liquid, thus said void is filled with heat medium liquid 5. Also thin void 12 formed between the outer periphery of the heating wire 4 and the porous material 10 in the portion exposed above the free level 8 of the heat medium liquid 5 is filled with heat medium liquid by capillary action. Thus overall surface of the electric heater 4 is covered by a thin film of heat medium liquid.

As the electric heater 4 has in its inside an electric wire 15 and heat resistant insulator 16, a thin layer of the heat medium liquid 5 in the void 12 is heated in the state of face contact to the electric heater 4 when the electric wire 15 is energized and the temperature of the electric heater 4 gets arise. That is, small amount of film state heat medium liquid is easily heated by heat conduction from the heater 4 and the liquid is immediately vaporized and flows upward into a vapor chamber 9.

As soon as the heat medium liquid 5 in the void 12 has vapored, the void 12 is immediately filled with the heat medium liquid 5 with capillary action from beneath the liquid level.

Thus the vaporing of the thin film of the heat medium liquid 5 in the void 12 and supply of the liquid thereinto by capillary action are simultaneously and continually effected whereupon the vapor chamber 9 is always filled with heat medium vapor and in turn, channels 14 in a plurality of the elongate vessels 1 communicated with the vapor chamber 9 are filled with vapor. With the heat of the heat medium vapor in the vapor channel 14 of the closed elongate vessel 1, the treated material 19 contacting a heat exchange surface 17 is uniformly heated.

In this instance, the heat medium vapor is again liquified into condensate and falls back along the vessel 1 into the heat medium container 3. Therefore the absolute volume of the liquid 5 at all times remains unchanged, thus it is sufficient only with such volume that the lower part 6 of the electric heater 4 is immersed in the liquid. Indeed this is economical since substantially only very small volume of the liquid is require to effect heating.

Grooves 18 may be formed in the heat exchange face 17 of respective elongate closed vessels 1 for guiding treated yarn. A narrow tube 20 communicates the upper part of the respective elongate vessel 1 with the horizontal condensate trough 2 so that the pressure in the inside of the vessels 1 becomes uniform. A throttled portion 21 is provided in each of the narrow tube 19 so that the low boiling point vapor remaining in the upper inside of each vessel 1 is introduced by venturi action into the horizontal condensate trough 2.

As the condensate trough 2 is less heat insulated then the other portions, its temperature comes lower with natural cooling from the outside so that its inside pressure comes to drop whereupon the heat medium vapor in the vessels 1 is absorbed into the condensate trough 2 and therein the vapor is condensed into liquid. The liquified heat medium returns to the elongate heat medium liquid container 3.

Figure 2:
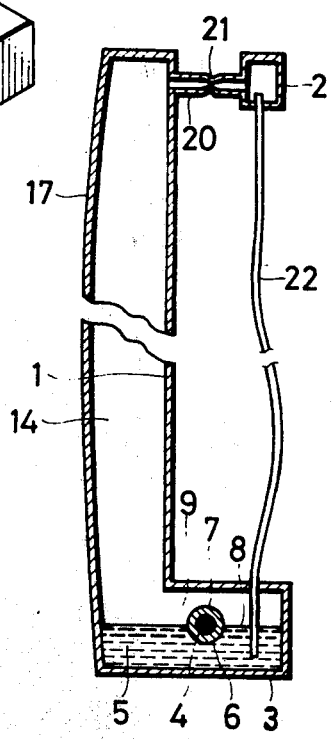
FIG. 2 is a cross section view in large scale taken along the line II—II in FIG. 1.
Figure 3:
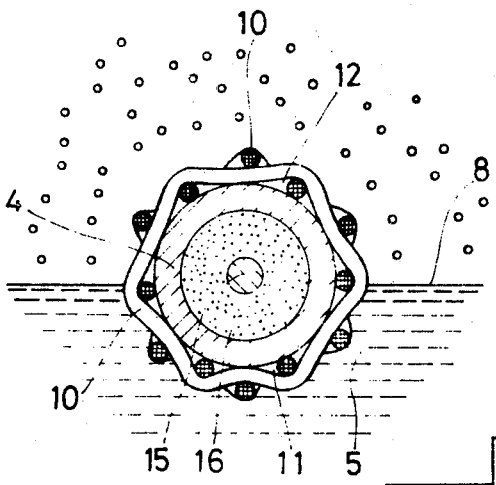
FIG. 3 is a partial detailed view of FIG. 2 with a cross section of a heater.
Figure 4:
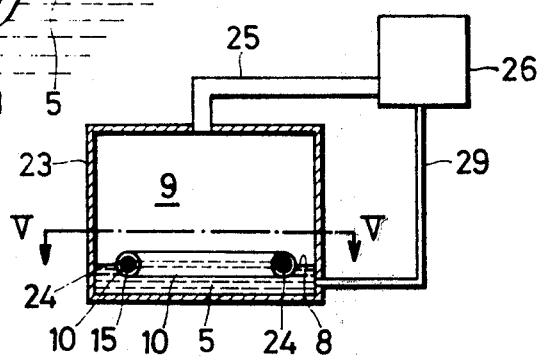
FIG. 4 is a diagrammatic view of a heating apparatus with heat medium vapor of another embodiment.
Figure 5:
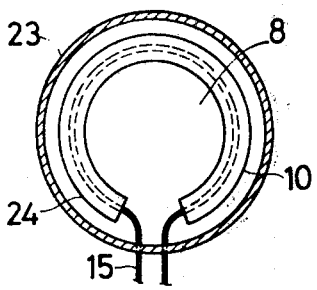
FIG. 5 is a cross section view taken along the line V—V in FIG. 4.

The heat medium vapor generating apparatus shown in FIG. 4 comprises a cylindrical heat medium container 23 filled with a heat medium liquid 5 in its bottom and therein a ring shape heater 24 is provided partially immersed in the liquid. The upper part of the heat medium container 23 is communicated through a pipe 25 to a heat exchanger 26 and the lower part of the heat medium container 23 is communicated through a return pipe 29 with the heat exchanger 26. The parts having same numerals in FIG. 4 and 5 with those in FIGS. 1 – 3 perform same functions.

Figure 6:
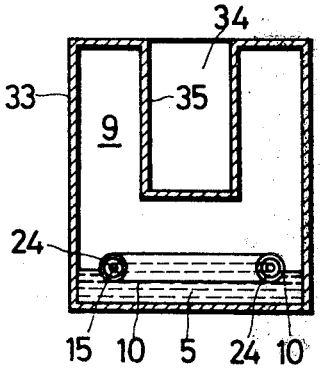
FIG. 6 is a longitudinal cross section view of a heating apparatus of a still another embodiment.

Another embodiment shown in FIG. 6 comprises a heat medium container 33, in the center of which is formed a heating chamber 34 in which heat treated material is placed and the periphery of the heating chamber 34 forms heat exchange face 35. In FIG. 6, the parts having same numerals with those in FIGS. 1 – 5 perform same functions.

What is claimed is:

1. A heating apparatus with heat medium vapor, including a plurality of closed elongated vessels having surfaces for receiving fibrous materials, the upper parts of the vessels being communicated with a lateral condensate trough and the lower parts of the vessels being communicated to one another with a heat medium liquid container, the bottom of which contains a substantially constant level of a heat medium liquid, and a heat medium vapor chamber formed on the free level of the heat medium liquid, the improvement comprising:

an electric heater of elongated, form placed along the free level of the heat medium liquid in the heat medium container, and being only partly immersed therein so that the upper surface of the heater projects above the free surface of the liquid; and a means for wicking a thin film of liquid by capillary action from the heat medium liquid onto the upper, non-immersed surface of the heater, said means comprising a single layer of porous mesh telescoped over the heater and in contact therewith;

said porous mesh defining a plurality of voids adjacent said heater throughout its periphery and length, above and below the liquid medium level; the voids above said liquid medium level constantly filling with fluid medium liquid by capillary action so that a thin film of liquid is constantly placed in heat exchange contact with the upper, unimmersed surface of the heater for evaporation.

* * * * *